US006974390B2

(12) United States Patent
Shioda

(10) Patent No.: US 6,974,390 B2
(45) Date of Patent: Dec. 13, 2005

(54) GOLF PRACTICE SYSTEM

(76) Inventor: Yoshihiko Shioda, 4603 S. Boulevard, Charlotte, NC (US) 28209

( * ) Notice: Subject to any disclaimer, the term of this patent is extended or adjusted under 35 U.S.C. 154(b) by 236 days.

(21) Appl. No.: 09/748,046

(22) Filed: Dec. 22, 2000

(65) Prior Publication Data

US 2002/0082101 A1 Jun. 27, 2002

(51) Int. Cl.[7] ..... A63B 69/36
(52) U.S. Cl. ..... 473/150; 473/197; 473/280
(58) Field of Search ..... 473/165, 197, 473/168–170, 131, 351, 352, 280, 256, 195, 172; 273/400–402

(56) References Cited

U.S. PATENT DOCUMENTS

| | | | | |
|---|---|---|---|---|
| 1,759,156 A | | 5/1930 | Fish | |
| 3,427,030 A | | 2/1969 | Ward | 273/176 |
| 3,721,447 A | | 3/1973 | Louderback | |
| 3,729,195 A | | 4/1973 | Hutt et al. | 273/58 C |
| 3,764,140 A | | 10/1973 | Lofty | 273/95 A |
| 3,837,653 A | | 9/1974 | Fox et al. | |
| 4,026,561 A | * | 5/1977 | Baldorossi et al. | 473/256 |
| 4,150,826 A | | 4/1979 | Baldorossi et al. | 273/218 |
| 4,208,053 A | | 6/1980 | Farr | |
| 4,240,629 A | | 12/1980 | Song et al. | 2373/58 C |
| 4,326,717 A | | 4/1982 | McClimon | 273/181 F |
| 4,359,225 A | | 11/1982 | Baldorossi et al. | 273/178 A |
| 4,531,742 A | | 7/1985 | Craycraft | |
| 4,660,834 A | * | 4/1987 | Carrigan | 473/165 |
| 4,872,676 A | | 10/1989 | Townsend | |
| 4,886,275 A | | 12/1989 | Walker | |
| 4,940,238 A | * | 7/1990 | Bradley | 273/DIG. 20 |
| 4,989,876 A | * | 2/1991 | Hawkins et al. | 273/DIG. 20 |
| 5,026,054 A | | 6/1991 | Osher et al. | 273/58 A |
| 5,380,002 A | * | 1/1995 | Spector | 473/519 |
| 5,407,211 A | * | 4/1995 | Bottiglieri | 273/400 |
| 5,630,763 A | | 5/1997 | Li-Tsan | |
| 5,876,291 A | | 3/1999 | Dubose | 473/197 |
| 6,012,997 A | | 1/2000 | Mason | |
| 6,053,829 A | | 4/2000 | Conley | 473/594 |
| 6,190,272 B1 | * | 2/2001 | Bernard | 273/400 |
| 6,217,458 B1 | * | 4/2001 | Armstrong et al. | 473/165 |
| 6,319,145 B1 | | 11/2001 | Coughlan | 473/197 |
| 2002/0082101 A1 | | 6/2002 | Shioda | 473/197 |
| 2002/0111222 A1 | | 8/2002 | Shioda | 473/197 |

FOREIGN PATENT DOCUMENTS

EP 1 219 327 A2 7/2002

OTHER PUBLICATIONS

U.S. patent application Ser. No. 09/444,120, Shioda, filed Nov. 19, 1999.
Copy of "Impact Bag" pamphlet by Dr. Gary Wiren.

* cited by examiner

*Primary Examiner*—Mark S. Graham
(74) *Attorney, Agent, or Firm*—Kennedy Covington Lobdell & Hickman LLP

(57) ABSTRACT

A golf practice and exercise system having a practice ball and a target assembly, using either a conventional or practice golf club. The practice ball is any generally spherical shape made of a flexible material and having an internal pressure of approximately atmospheric, for example an uninflated soccer ball. The weight of the practice ball is sufficient to provide muscle development, but is limited to allow the golfer to complete the follow-through of the golf swing. The target assembly has an energy absorbing surface attached to a rigid frame held in place by a frame support structure. Alternatively, the target assembly is a flat surface made of a hard material. The practice golf club has a substantially oversized club head with a peripheral rim defining a large opening through the club head. The club head may be selectively weighted. The grip of the club has alternating annular ridges and recesses.

28 Claims, 14 Drawing Sheets

GOLF PRACTICE SYSTEM

FIELD OF THE INVENTION

The present invention relates to golf practice and exercise systems that improves the user's golf swing and develops the muscles used in a golf swing.

BACKGROUND OF THE INVENTION

There are many prior devices that have been developed for golfers to practice to improve their swing. One type suspends a golf ball-sized object from the end of a cord in a position for being struck by the head of a golf club being swung by a golfer. Such devices allow a golfer to practice his swing and improve the technique and path of a swing in a confined space instead of having to use a driving range. However, the object being struck is a golf ball or the size of a golf ball and, therefore, provides little muscle-building resistance.

In my prior application, Ser. No. 09/444,120, an object is suspended by a rope from a frame arm or tethered to a rope anchored in the ground in position for being struck by the head of a golf club being swung by a golfer. The object has an impact surface approaching the size of or greater than the corresponding surface of a standard softball and has a mass approaching that of or exceeding that of a standard softball. This device provides for practicing the technique of the golf swing, as well as providing muscle development to enhance the striking force exerted by the golfer when striking a golf ball. However, the object is restricted by the rope so that the distance traveled by the object is extremely limited, thereby preventing the golfer from observing the ball in flight to determine the correctness of his swing.

Another type of practice device is a relatively large bag known as an Impact Bag that is intended to be filled with soft material, such as towels, and is placed against a stationary object that prevents displacement of the bag. Such a device is intended to stop a practice swing at the point of impact so that the golfer can evaluate the club's and his body's positions at impact. It does not allow the golfer to complete the follow-through of a golf swing and to perform a muscle building exercise by overcoming the resistance of a weight as the club moves through impact into the follow-through.

Yet another type of practice device, disclosed in U.S. Pat. No. 3,721,447, uses a contact engaging textile material pad adhered to a conventional golf club face in combination with a similarly covered ball sized similarly to a standard golf ball. The pad is marked with lines. When the golf club is swung and contacts the ball, the ball releasably adheres to the club face and the golfer can see by the lines marked on the pad the possible travel of the ball, thus determining the correctness of the swing. This device does not offer any muscle building exercises. Furthermore, this device does not allow the golfer to have visual confirmation of the travel of the ball, the markings on the pad provide an approximation of the travel of the struck golf ball.

In contrast, the present invention provides a combination of practicing techniques for controlling the direction of flight of the golf ball as well as building the muscles used in swinging a golf club. The present invention allows the golfer to watch the travel path of the practice ball, thereby confirming the consequence of each practice swing. But, the target assembly limits the distance the practice ball travels so a golfer can use the present invention in a confined space if desired. Also, the practice ball is of the size and mass that provides significant resistance to the golf swing, thereby providing the golfer with muscle building exercise to increase the golf swing power.

SUMMARY OF THE PRESENT INVENTION

Briefly described, the golf practice and exercise system of the present invention includes a practice ball and a target assembly. Either a conventional golf club or a practice golf club, described below, may be combined with the golf practice and exercise system. The practice ball has a size that approaches or approximates the size of a non-inflated soccer ball to provide a large target so that the golfer can swing freely without concentrating on striking a small target, such as a regulation golf ball. The practice ball also has a weight exceeding that of a regulation golf ball to provide substantial resistance to the impact of a golf club to impose muscular strain on the golfer for muscle development, but the practice ball is limited in weight to allow the golfer to complete the follow-through of the golf swing. Thus, the system of the present invention provides for practicing the technique of the golf swing, as well as providing muscle development to enhance the striking force exerted by the golfer when striking a golf ball.

The practice ball is generally spherical made of a pliable material. In the preferred embodiment, the practice ball may be substantially the same as a non-inflated soccer ball or a volleyball. The practice ball has an internal pressure of about atmospheric pressure to provide resistance for exercising muscles, prevent injuries to the user and to provide it with a low coefficient of elastic restitution to limit the distance traveled by the practice ball upon impact with a golf club and to limit the rebound of the practice ball upon contact with the target assembly. The practice ball is not tethered nor has any manner in which to be attached to a tether.

The practice ball is such that if the user strikes the practice ball from a striking position a sufficient distance from the target assembly, approximately 10 to 40 feet, the practice ball will travel in the manner corresponding to the golf swing—an incorrect swing may cause the ball to curve either right or left and a correct swing will cause the ball to travel in a direct path. The greater the distance between the striking position and the target assembly, the more obvious the travel path of the practice ball.

It should be understood that the present invention could be adapted to other shapes and sizes that provide a large enough striking surface on the practice ball that the practicing golfer need not concentrate on the precise location of striking, which a golfer must do with a small object, such as a golf ball, and is of sufficient weight to provide muscle building resistance yet can be displaced by a practice swing so that the golfer is able to complete the follow-through of the swing for the feel and practice of a complete swing.

In one embodiment, the target assembly has an energy absorbing surface, preferably mesh netting attached to a rigid net frame by adjustable fasteners. The netting may be surrounded by a strip of material having a plurality of holes spaced at a regular interval. The adjustable fasteners, for example S-hooks, clips, chains, rope or coiled springs, are inserted through the holes and attached to projections affixed to the rigid net frame. The energy absorption of the netting can be adjusted by these adjustable fasteners.

In the preferred embodiment, the rigid net frame is substantially rectangular. It should be appreciated, however, that the rigid net frame can be any shape upon which a netting can be adjustably attached.

The rigid net frame is supported by a frame support structure that maintains the rigid net frame in the proper spatial orientation. In one form, the frame support structure is made up of a base upon which rests the rigid net frame, the base being of sufficient size to prevent the rigid net frame from becoming unbalanced upon contact of the practice ball. Another form of the frame support structure is made up of a plurality of essentially triangular members, one member attached to or integral to each vertical side of the rigid net frame. The netting is adjusted such that the practice ball contacts the netting and rolls down the netting to the floor or ground and is directed back toward the striking position. To facilitate the return of the practice ball to the striking position, a ball return panel may be placed behind the netting, extending horizontally across the lower portion of the netting. In one embodiment, the ball return panel is oriented such that it angles up and away (rearward) from the netting so that a practice ball moving downwardly along the front of the netting engages the ball return panel and is thus directed away from the target assembly and toward the ball striking position.

In another embodiment, the target assembly has a flat surface made of wood, concrete, brick or other material that is such that the practice ball rebounds from the target assembly and is directed toward the striking position.

The golf practice and exercise system may be used with a conventional golf club or a practice golf club. The practice club has a substantially oversized club head. The sole of the club head is generally rounded to lessen the wear on the floor, ground, or a practice mat used in conjunction with the present invention.

The practice club head has a face, which strikes the practice ball, and a back. In one embodiment, the club head has a peripheral rim that defines a large opining through the club head. The opening reduces the resistance that would ordinarily be experienced by a golfer swinging closed-face, oversized club head..

The practice club head may be selectively weighted. In one embodiment, the weight is added by securing plates to the back of the club head. In another embodiment a horizontal recess extending from the toe of the club toward the heel of the club is formed in the lower portion of the club head and weighted disks are inserted into the recess through the opening in the toe of the club head. The weighted disks are secured in the recess by a locking cap threaded into the recess opening at the toe of the club head.

In any embodiment, the club head is attached to a shaft. A grip surrounds the shaft on the end opposite the club head. The grip has a plurality of alternating annular ridges and recesses. These ridges and recessed are intended to provide a user with a more secure grip, especially when using a heavier practice ball. These ridges and recesses can be of any dimension sufficient for providing enhanced gripping.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
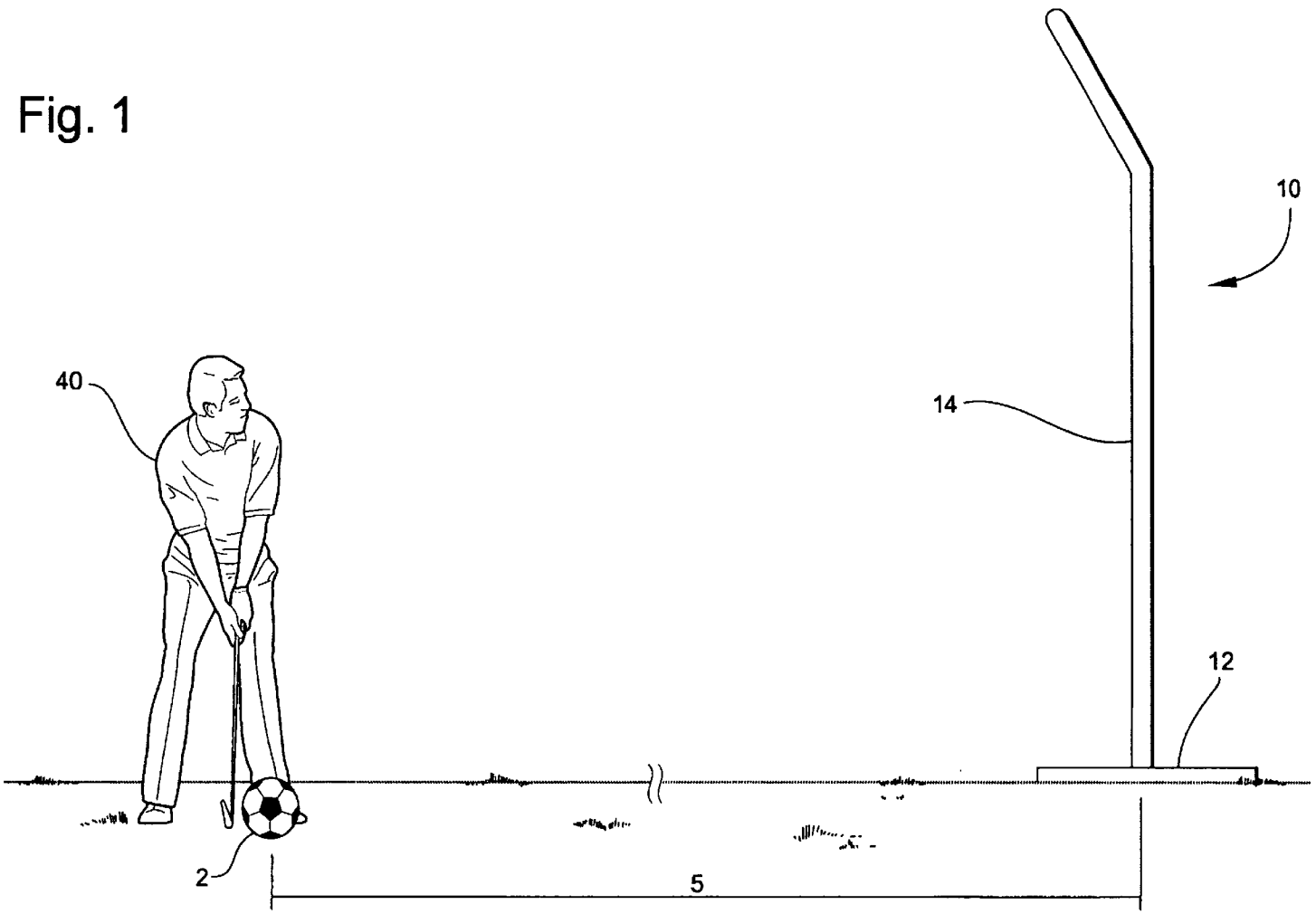
FIG. 1 is a side elevational view of a golf practice and exercise system according to one of the preferred embodiments of the present invention, illustrating a golfer preparing for a practice swing at the practice ball into the target assembly.
Figure 2:
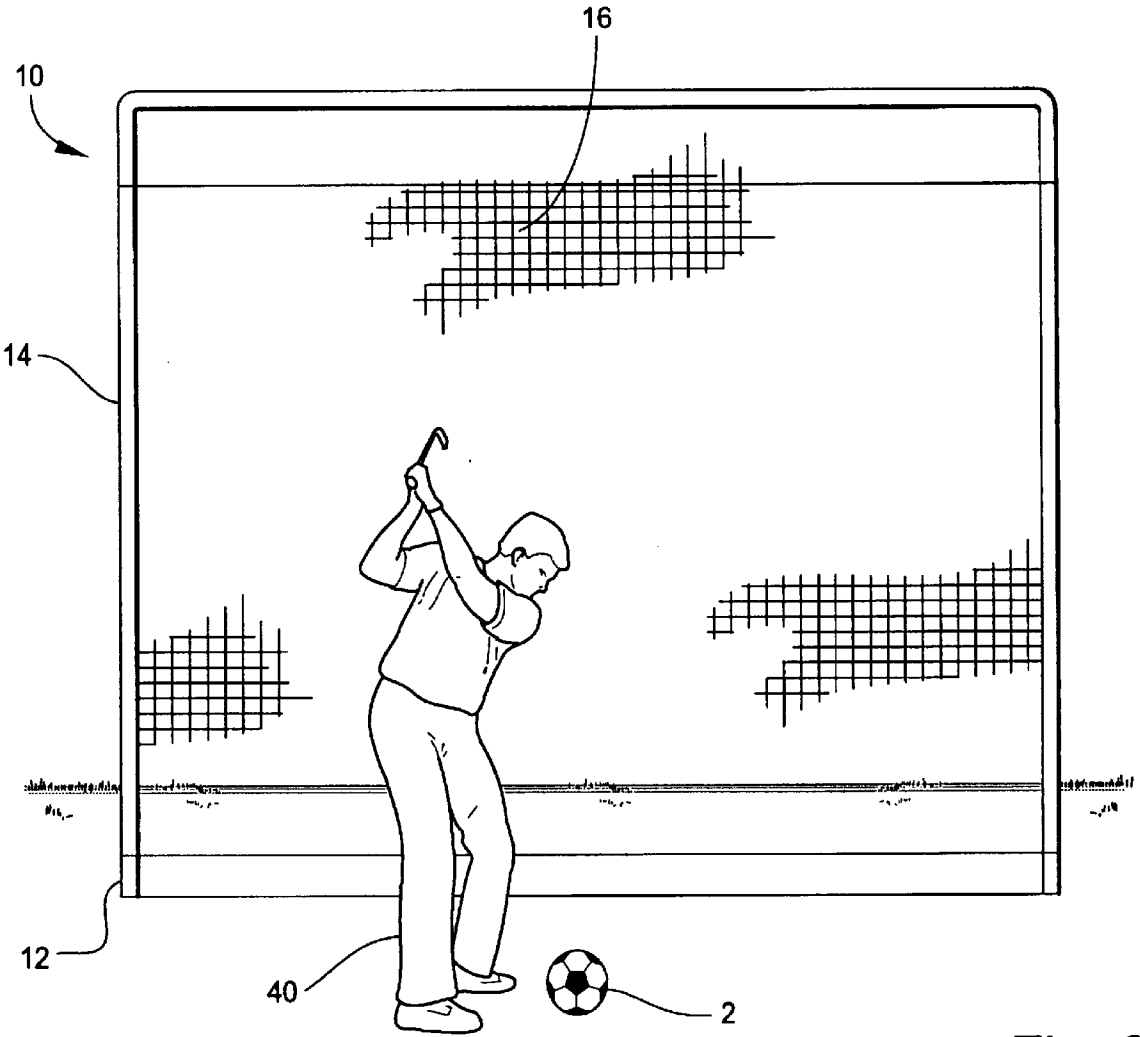
FIG. 2 is a front elevational view of the system of FIG. 1, illustrating a golfer with a golf club in the striking position.

A first preferred embodiment of the golf practice and exercise system of the present invention is illustrated in FIGS. 1 and 2. The system includes a practice ball 2 and a target assembly 10. A practice club 30 is also shown. The size of the practice ball 2 approximates the size of a non-inflated soccer ball to provide a large target so that the golfer can swing freely without concentrating on striking a small target as is the case when swinging at a golf ball. The target assembly 10 includes a rigid net frame 14, an energy absorbing surface, preferably a mesh netting 16 attached to the rigid net frame 14 and a frame support structure 12. The rigid net frame 14 is substantially rectangular and held in the desired spatial orientation by the frame support structure 12. In this preferred embodiment, the frame support structure 12 is a base upon which is disposed the bottom of the rigid net frame 14. The frame support structure 12 rests on the ground or floor of the practice area and is of sufficient size to maintain the rigid net frame 14 in the proper spatial orientation upon impact with the practice ball 2.

In the embodiment illustrated in FIGS. 1 and 2, the practice ball 2 is substantially similar to a non-inflated standard soccer ball or volley ball. Typically, the practice ball 2 will be spherical with an outer surface made of flexible material. The construction and the non-inflated disposition of the practice ball 2 results in the practice ball 2 having a low coefficient of elastic restitution that limits the travel of the practice ball upon contact with the golf club and limits the rebound upon contact of the practice ball 2 against the target assembly 10.

When a golfer 40 uses the system of FIGS. 1 and 2, he positions himself at a striking position 5, approximately 10 to 40 feet from the target assembly, in an address position with the golf club 30. The golfer 40 then takes a normal back swing and then a down swing with the club 30, making impact with the practice ball 2. The practice ball 2 then travels in the direction imposed by the swing, either curving right or left or following a straight path. The practice ball 2 impacts the target assembly 10 and rolls back toward the golfer 40. The practice ball 2 is sufficiently large that the golfer 40 does not have to concentrate on hitting the practice ball 2 at a specific point, but rather can concentrate of his technique for controlling the direction of travel of the practice ball 2. Furthermore, the practice ball 2, having a weight greater than that of a standard golf ball, offers extra resistance to the golfer 40, providing him with exercises to strengthen muscles and increase the power of his swing.

In the preferred embodiment illustrated in FIGS. 4, 6, 7, and 8, the netting 16 is adjustably attached to the rigid net frame 14 by adjustable fasteners 24. The netting 16 is surrounded by and fixedly attached to a strip of material 26. Holes 28, are cut in the strip of material 26 at regular intervals. The adjustable fasteners 24 are connected to the strip of material 26 through the holes 28. The adjustable fasteners 24 may be any type fastener. One preferred embodiment, illustrated in FIG. 4, uses S-hooks for the adjustable fasteners 24. Another preferred embodiment, illustrated in FIGS. 6 and 7, use an elongated clip. Still another preferred embodiment, illustrated in FIG. 8, uses portions of chain threaded through the holes 28 in the strip of material 26.

Figure 3:
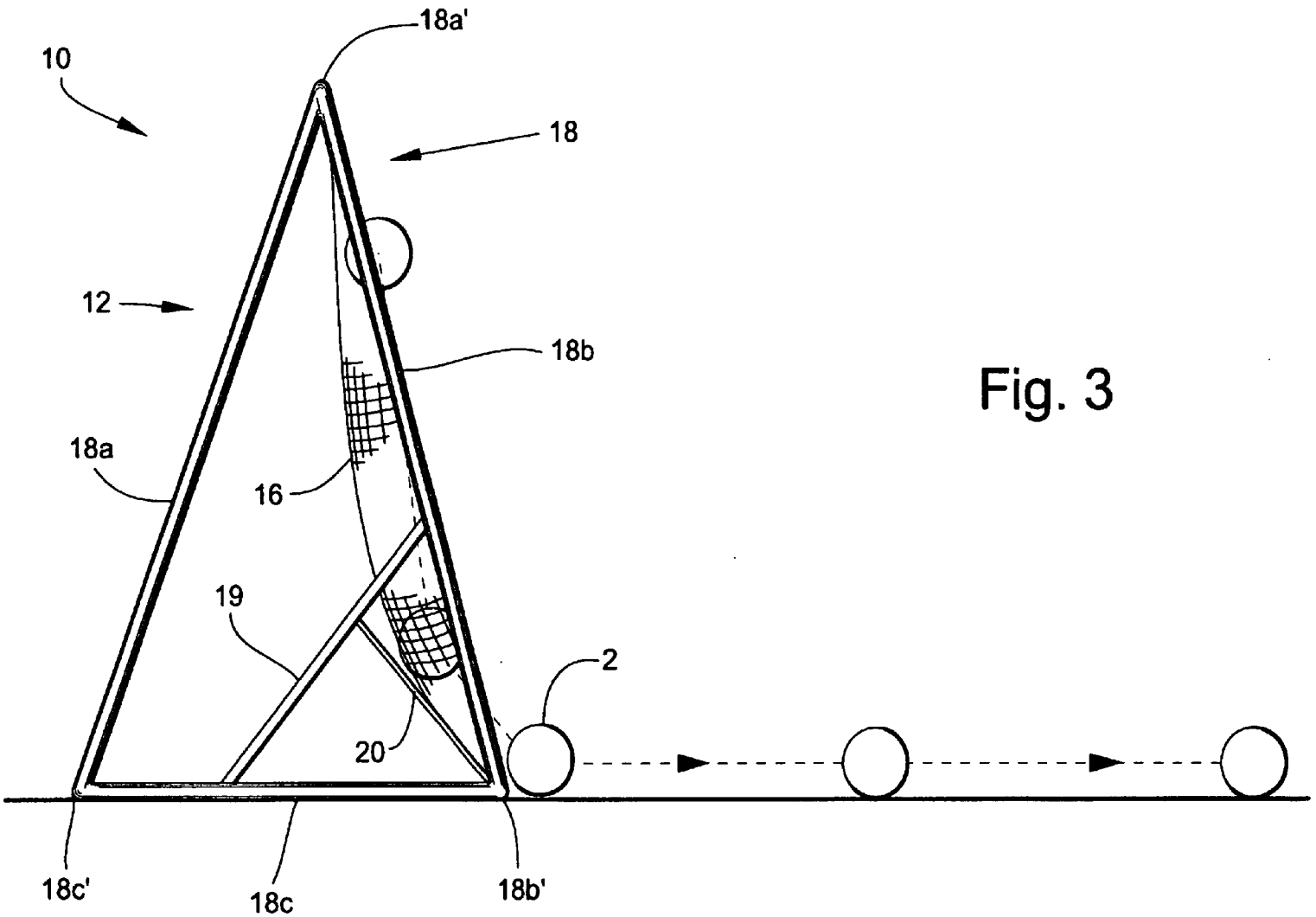
FIG. 3 is a side elevational view of a golf practice and exercise system according to one of the preferred embodiments of the present invention, illustrating one of the triangular support members used to support the rigid net frame and the movement of the practice ball upon contact with netting.
Figure 4:
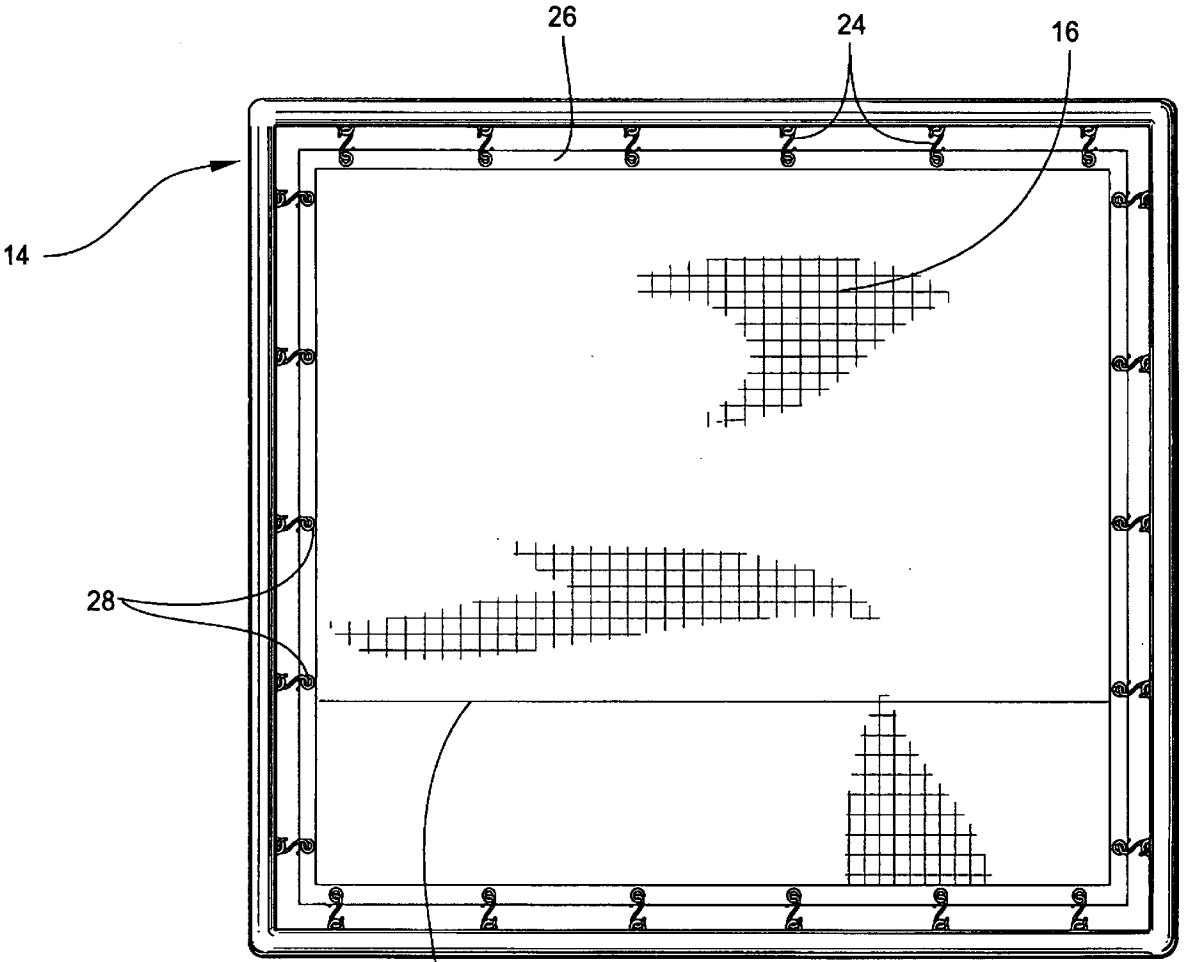
FIG. 4 is a front elevational view of the system of FIG. 3, illustrating one method for attaching the netting to the rigid net frame.

In the preferred embodiment illustrated in FIGS. 3 and 4, the frame support structure 12 includes at least two triangular support members 18 integral to each vertical side of the rigid net frame 14. The triangular support structure 18 has two angle members 18*a*, 18*b*, connected to each other at a top apex 18*a*'. One angle member 18*b* is the vertical side of the rigid net frame 14. The two angle members 18*a*, 18*b* are connected to a horizontal member 18*c* at corresponding bottom apexes 18*b*', 18*c*'. The horizontal member 18*c* rests upon the ground or floor of the practice area. An inner support member 19 is attached to the horizontal member 18*c* and angle member 18*b*. A ball return panel 20 is located between the inner support member 19 and the apex 18*b*' between the horizontal member 18*c* and the angle member 18*b*, behind the netting. The ball return panel 20 extends horizontally along a lower portion of the netting 16 and is oriented upwardly and rearwardly so that the ball return panel is angled away from the netting 16. Upon impact with the netting 16, the practice ball 2 travels downwardly along the front of the netting 16 and engages the ball return panel 20 which directs the practice ball 2 to approximately the striking position 5.

Figure 5:
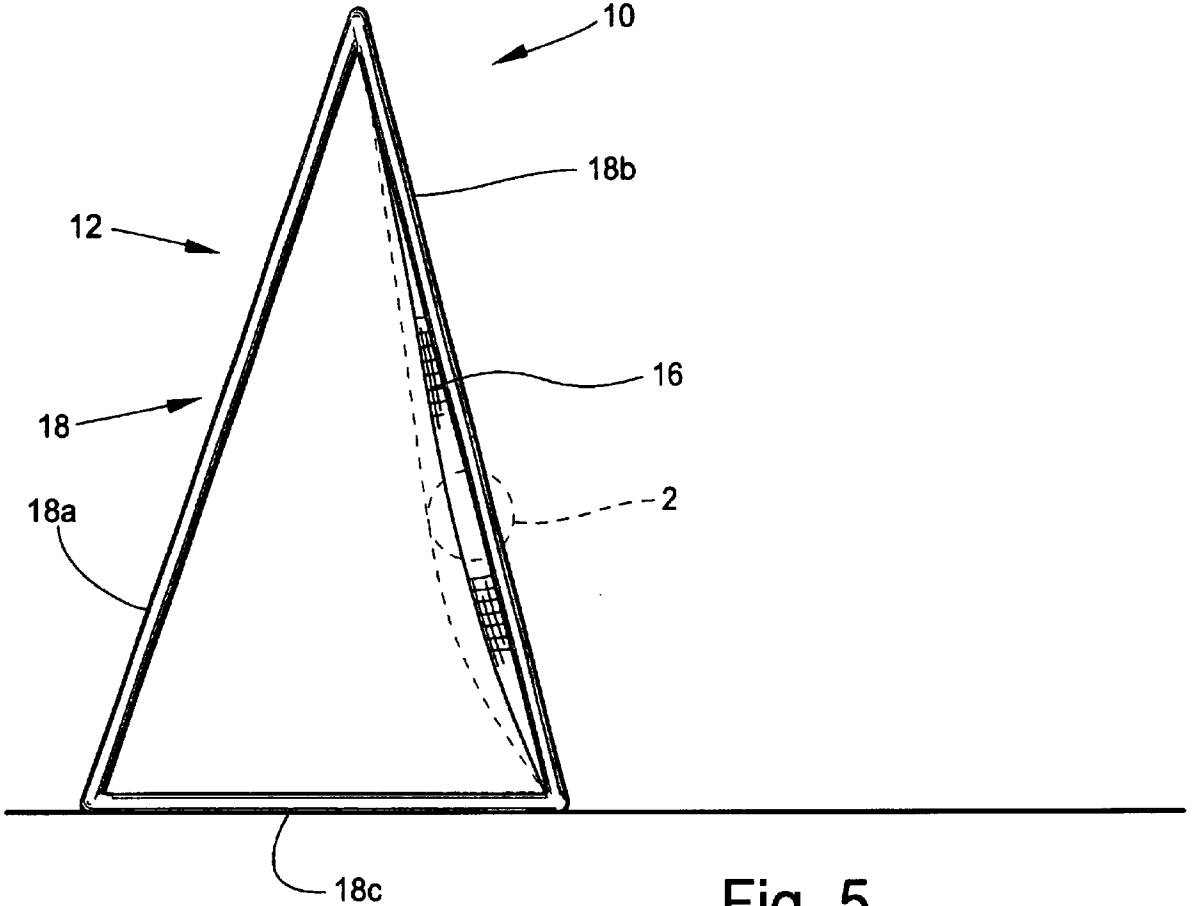
FIG. 5 is a side elevational view of a golf practice and exercise system according to one of the preferred embodiments of the present invention, illustrating one of an alternate triangular support member used to support the rigid net frame and the deflection of the netting upon contact with the practice ball.
Figure 6:
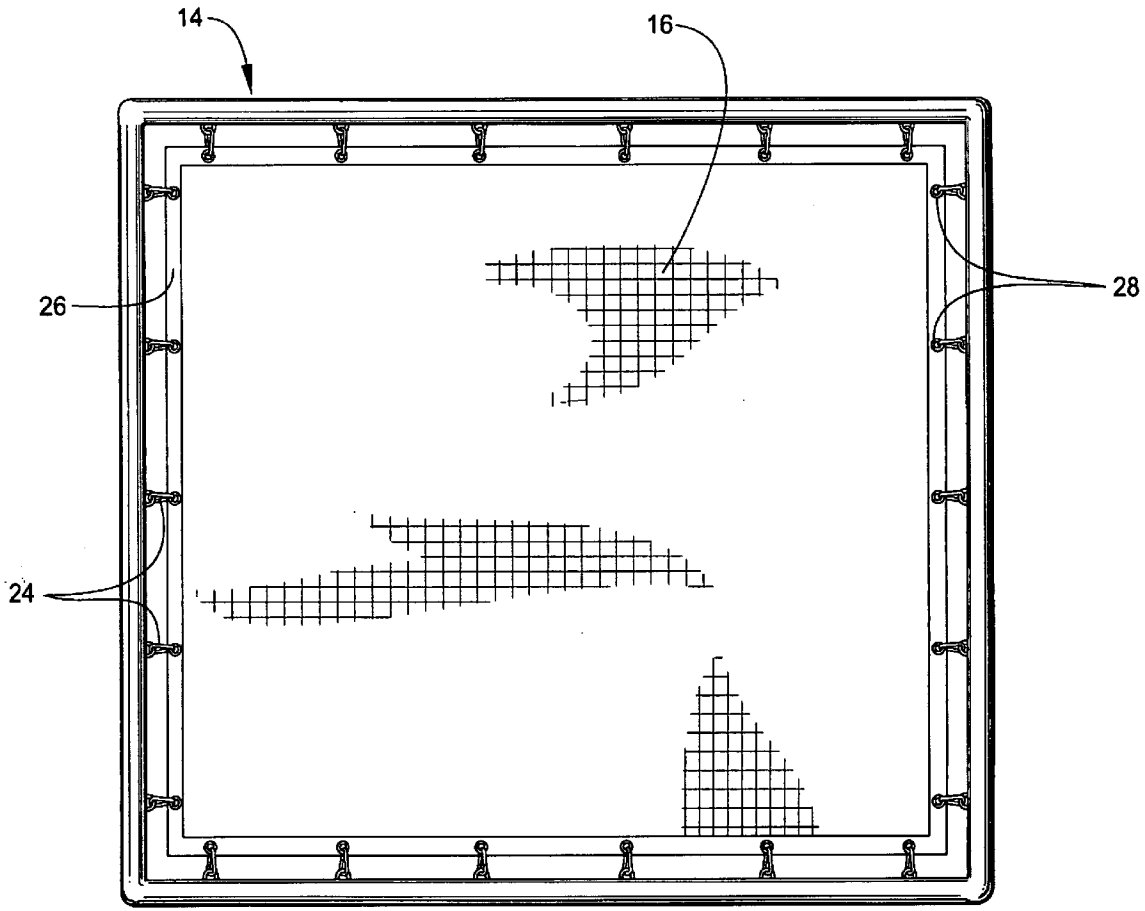
FIG. 6 is a view similar to FIG. 4, illustrating another method for attaching the netting to the rigid net.
Figure 7:
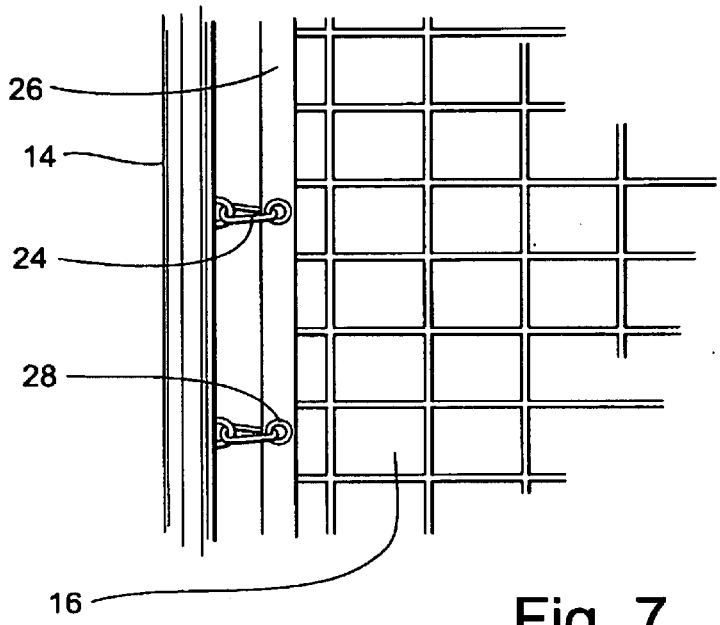
FIG. 7 is an enlarged view of a segment of Fib. 6, illustrating the attachment of the netting to the rigid net frame.
Figure 8:
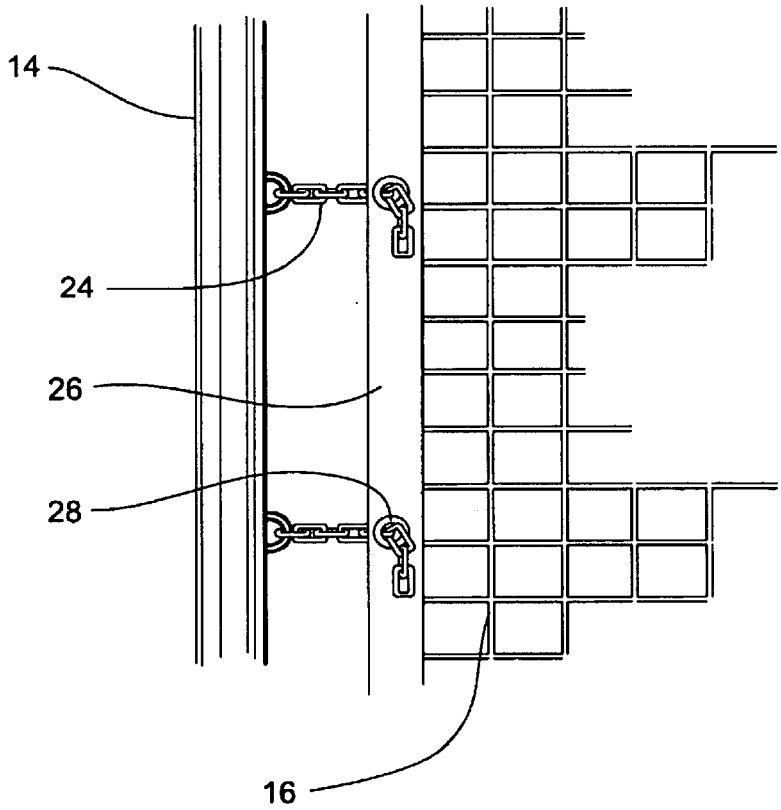
FIG. 8 is a view similar to FIG. 7, illustrating an alternate method for attaching the netting to the rigid net frame.

In another preferred embodiment, illustrated in FIGS. 5 and 6, the frame support structure 12 includes the triangular support structure 18 as described above, but with the inner support member 19 and the ball return panel 20 eliminated. In this embodiment, the motion of the netting 16 is unrestricted.

Figures 9, 10:
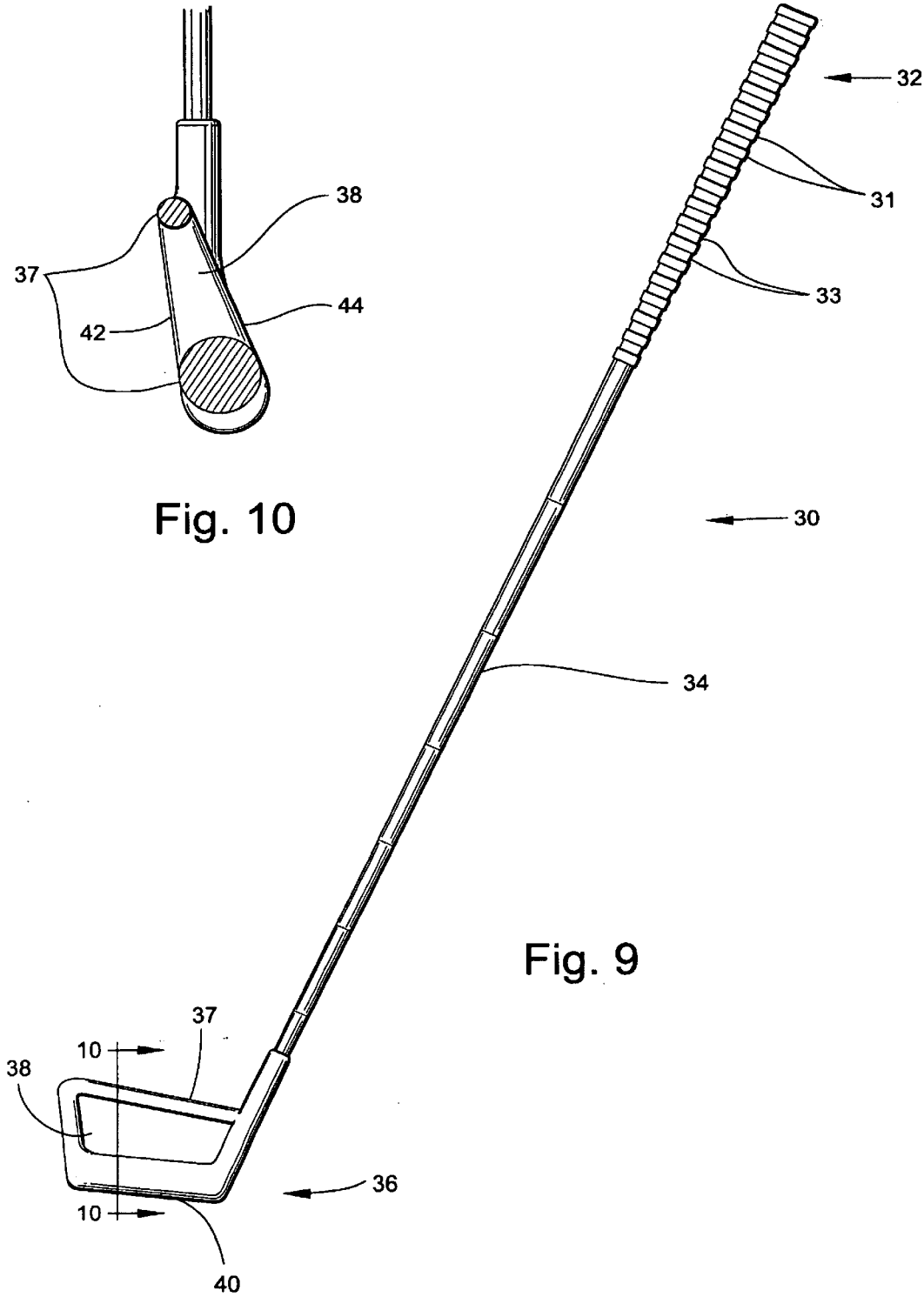
FIG. 9 is a side elevational view of a practice golf club according to the golf practice and exercise system of the present invention.
FIG. 10 is a vertical sectional view of the club head of the club of FIG. 9 taken along line 10—10 of FIG. 9.
Figure 11:
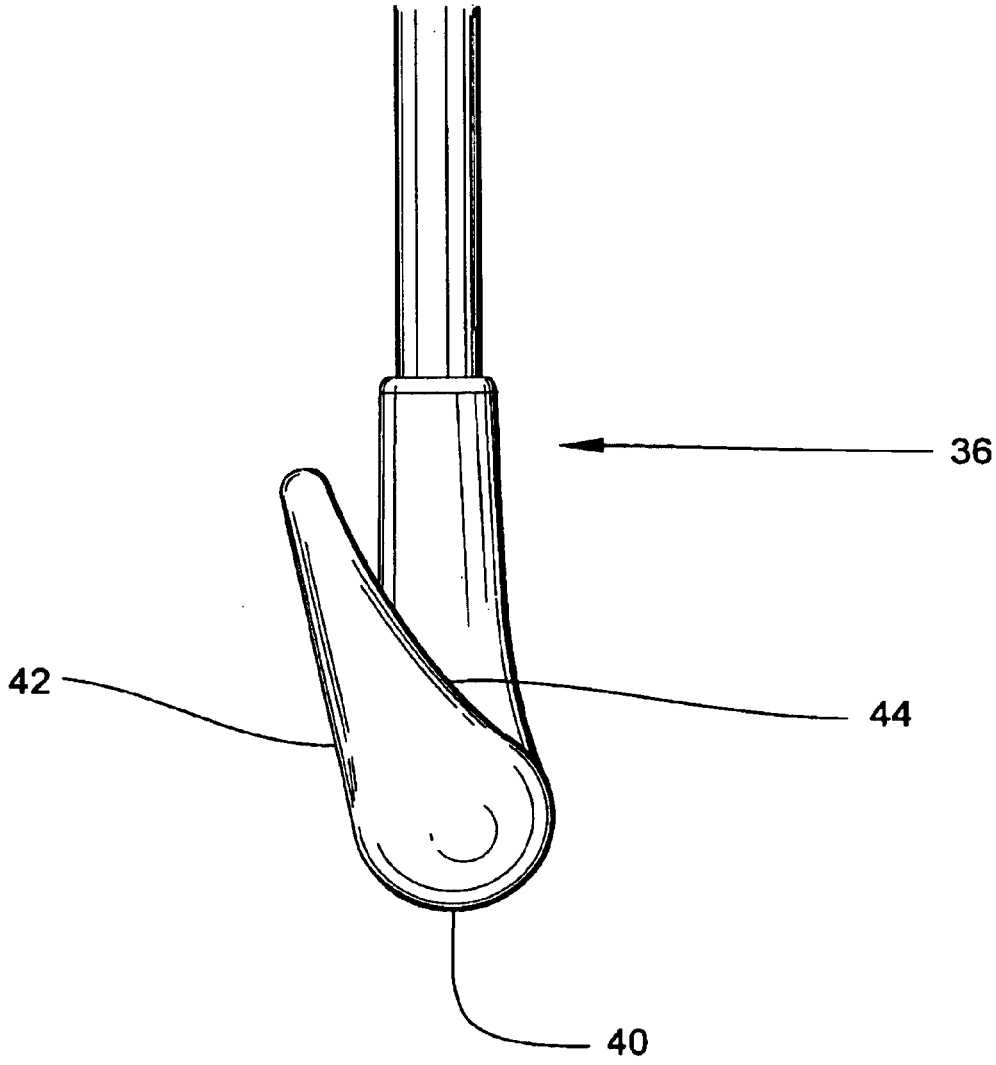
FIG. 11 is a front elevation view of the club head of the club shown in FIG. 9, illustrating the rounded sole of the club head.

In the preferred embodiment illustrated in FIGS. 9, 10 and 11, the golf club employed with the golf practice and exercise system is a practice golf club 30 having a substantially oversized club head 36. The club head 36 is attached to a club shaft 34. A grip 32 encloses the club shaft 34 at the end opposite the club head 36. The grip has a plurality of alternating annular ridges 31 and recesses 33 to provide a secure grip. These may be of any desired dimensions sufficient to provide enhanced gripping. The club head 36 has a face 44, a back 42 and a sole 40. The sole 40 is generally rounded to reduce the wear of the practice area surface due to repeated practice swings. The club head 36 has a peripheral rim 37 defining a large opening 38 extending through the club head 36. The opening 38 of the club head 36 reduces the wind resistance experienced by a golfer when swinging the practice club 30, making the practice club 30 feel and behave more like a conventional golf club.

Figure 12:
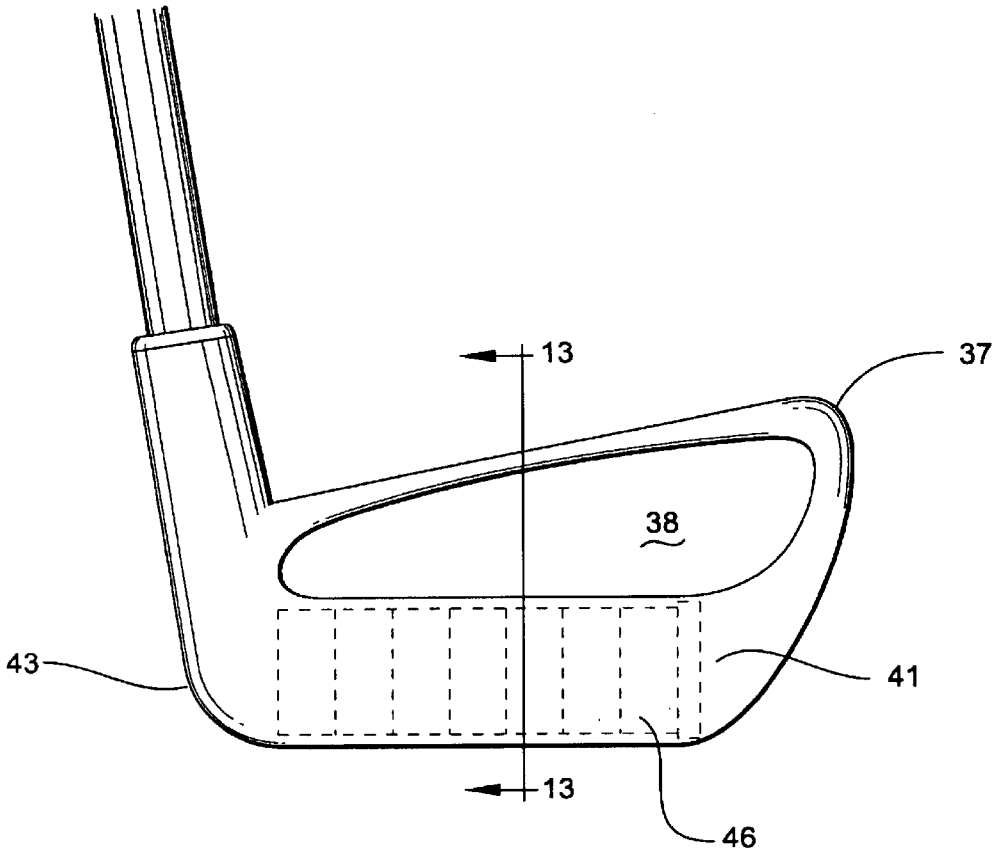
FIG. 12 is a rear elevational view of the club head of the practice golf club shown in FIG. 9, illustrating one of the preferred embodiments of adding weight to the club head.
Figure 13:
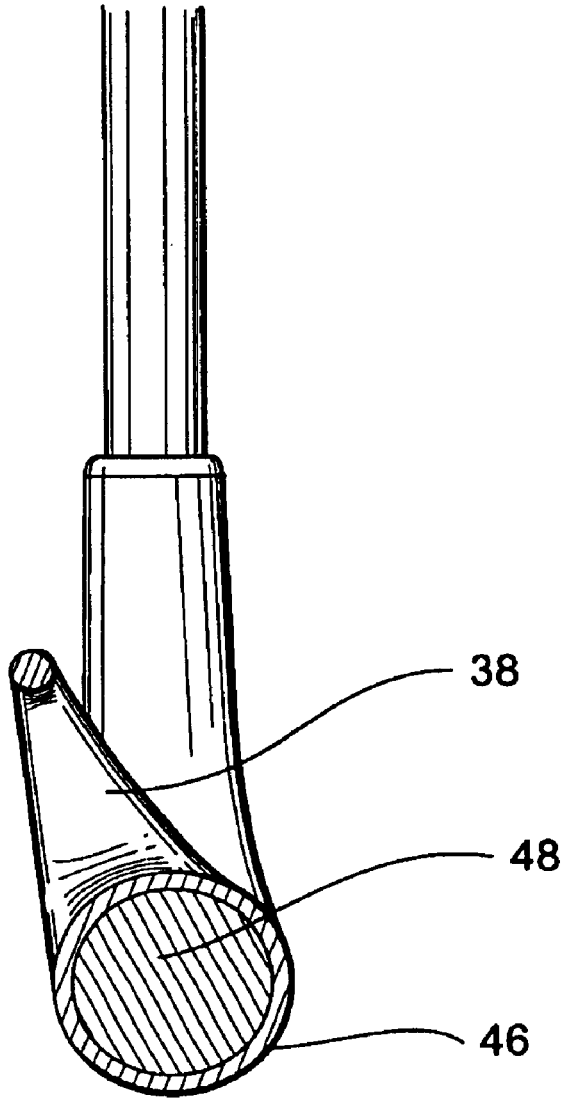
FIG. 13 is a vertical sectional view taken along line 13—13 of FIG. 12.
Figure 14:
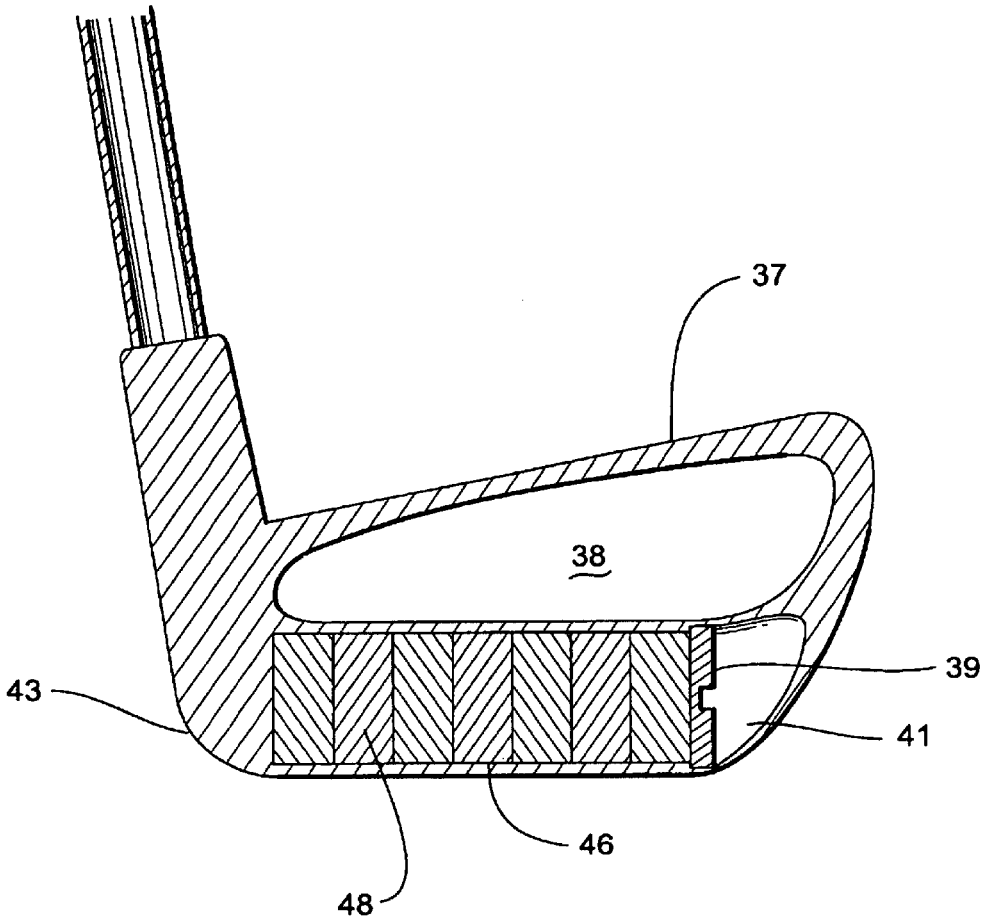
FIG. 14 is a vertical sectional view taken along line 13—13 of FIG. 12, illustrating the receipt of selectively weighted elements.

In one embodiment, the club head 36 may be selectively weighted. In a preferred embodiment illustrated in FIGS. 12, 13, and 14, a lower portion of the rim 37 of the club head 36 is formed with a recess 46 capable of receiving a plurality of weighted elements. The recess 46 extends horizontally from an opening at the toe 41 toward the heel 43 of the club head 36. The weighted elements, in the shape of disks 48 can be selectively inserted into the recess 46 through the opening at the toe 41 of the club head 36, thereby selectively weighting the club head 36 as desired by the user. A locking cap 39 is threaded into the recess 46 through the opening at the toe 41, securing the disks 48 in the recess 46.

Figure 15:
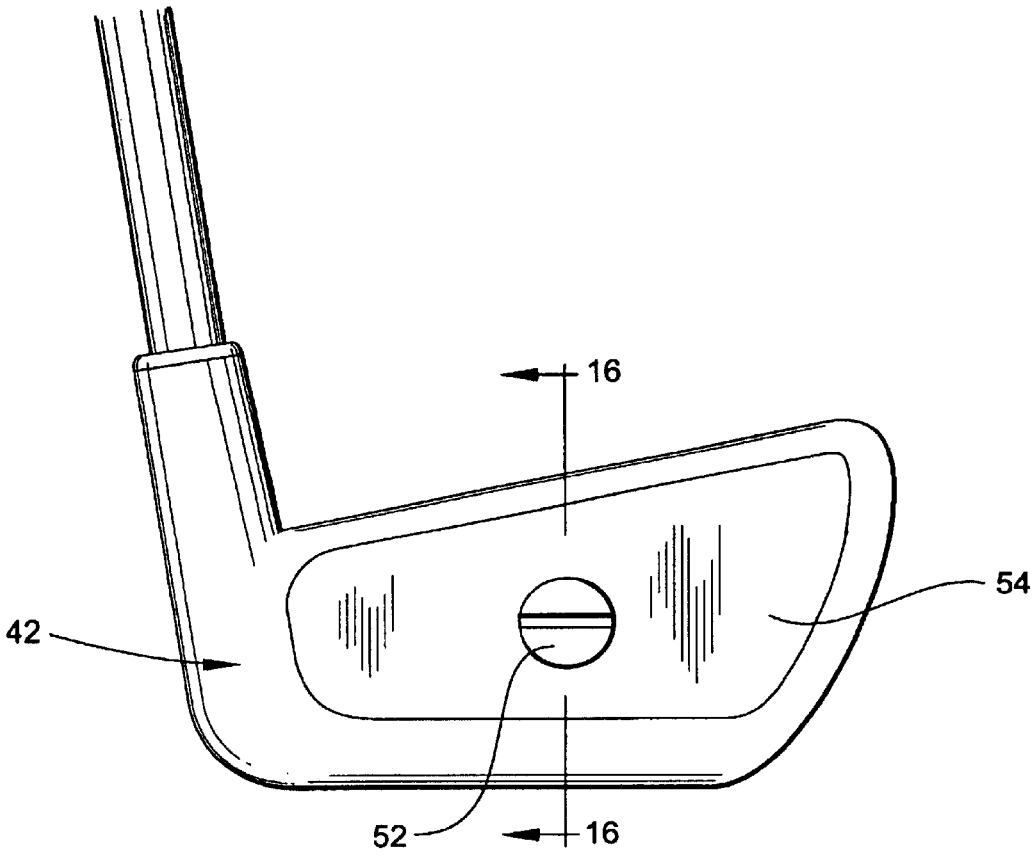
FIG. 15 is a rear elevational view of the club head shown in FIG. 9, illustrating an alternate preferred embodiment of adding weight to the club head by using plates affixed to the back of the club head with a screw.
Figure 16:
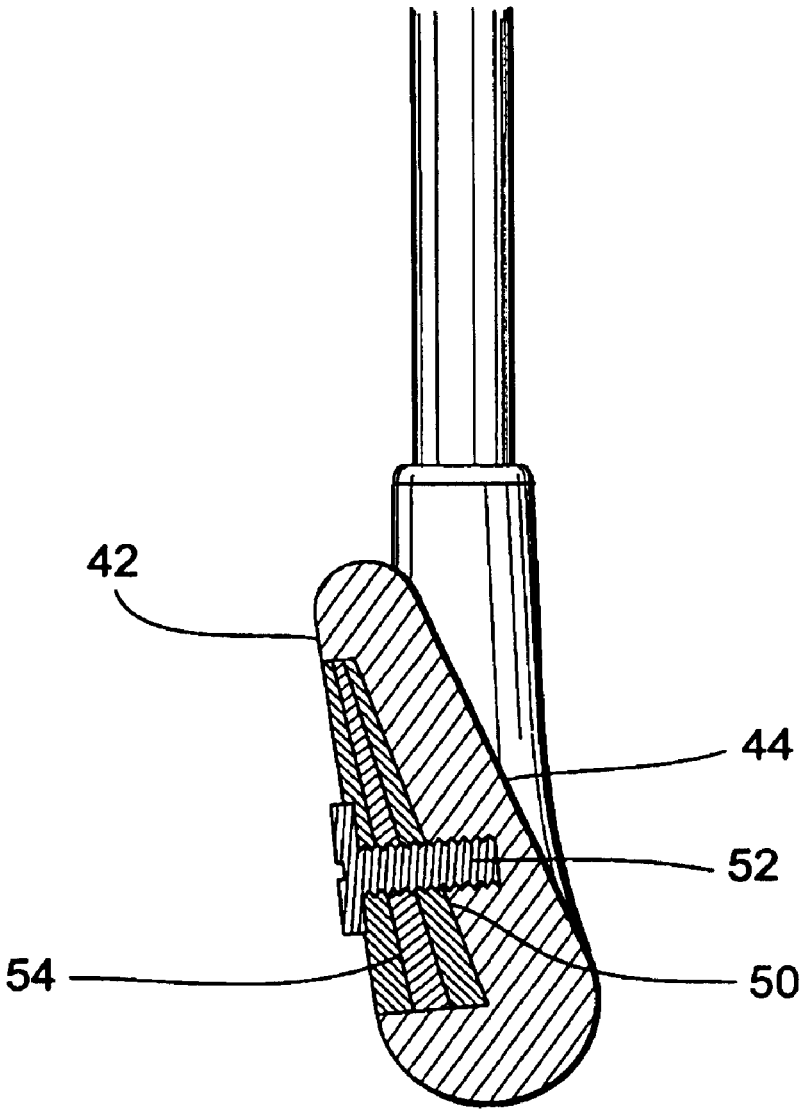
FIG. 16 is a vertical sectional view taken along line 16—16 of FIG. 15.

In another preferred embodiment illustrated in FIGS. 15 and 16, the opening 38 defined by the peripheral rim 37 of the club head 36 is eliminated and a groove 50 is formed into the back 42 of the solid club head 36. The groove 50 extends part way through the club head 36. A receptacle 56 for a screw 52 extends from the groove 50 further into the club head 36. Weighted plates 54 are inserted into the groove 50 and secured to the club head 36 by the screw 52. The number of weighted plates 54 inserted into the groove 50 can be changed to meet the golfer's requirements.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A golf practice and exercise system, comprising a golf club, a flexible, hollow uninflated practice ball of at least the approximate size of a non-inflated soccer ball and generally spherical and made of pliable material having a low coefficient of elastic restitution such when struck the practice ball travels a short distance relative to the striking force applied to it, and a target assembly against which the practice ball is propelled after being struck from a striking position a sufficient distance from the target assembly that when the practice ball is struck by a golf club swung by a golfer it travels in a direction imposed by the golfer's swing, whereby the gaffer can practice to control the travel of the practice ball and to develop golf swing strength.

2. A golf practice and exercise system according to claim 1 wherein the target assembly comprises a flat surface made of a sufficiently hard material such that the practice ball will rebound from the target assembly and travel back to approximately the striking position.

3. A golf practice and exercise system according to claim 1 wherein the target assembly includes an energy absorbing surface surrounded by and attached to a rigid frame, the rigid frame being maintained in proper spatial orientation by a frame support structure.

4. A golf practice and exercise system according to claim 3 wherein the energy absorbing surface is a mesh netting having a front surface and a back surface.

5. A golf practice and exercise system according to claim 4 wherein the netting is adjustably connected to the rigid frame by a plurality of adjustable fasteners.

6. A golf practice and exercise system according to claim 5 wherein the netting is surrounded by and affixed to a strip of material, the strip of material suitable for attaching the adjustable fasteners.

7. A golf practice and exercise system according to claim 4 characterized further by a ball return panel extending horizontally across a lower portion of the back surface of the netting.

8. A golf practice and exercise system according to claim 7 wherein the ball return panel is angled upwardly and rearwardly to engage the practice ball moving downwardly along the front surface of the netting to direct return of the practice ball to approximately the striking position.

9. A golf practice and exercise system according to claim 4 wherein the frame support structure includes a base on which is supported the rigid frame, the base being of sufficient extent to maintain the rigid frame in the proper spatial orientation.

10. A golf practice and exercise system according to claim 4 wherein the frame support structure includes at least two triangular support structures, the triangular support structure being integral to vertical sides of the rigid frame, each triangular support structure having two angle members and a horizontal member, each member connected to the other two members at apexes.

11. A golf practice and exercise system according to claim 10 characterized further by a ball return panel extending horizontally across a lower portion of the back surface of the netting, portions of the ball return panel being attached to portions of the triangular support structure.

12. A golf practice and exercise system according to claim 11 wherein the ball return panel is angled upwardly and rearwardly to engage the practice ball moving downwardly along the front surface of the netting to direct return of the practice ball to approximately the striking position.

13. A golf practice and exercise system according to claim 5 wherein the adjustable fasteners are S-hooks.

14. A golf practice and exercise system according to claim 5 wherein the adjustable fasteners are elongated clips.

15. A golf practice and exercise system according to claim 5 wherein the adjustable fasteners are links of a chain.

16. A golf practice and exercise system according to claim 1 wherein the golf club is a conventional golf club.

17. A golf practice and exercise system according to claim 1 wherein the golf club is a practice golf club having a substantially oversized club head.

18. A golf practice and exercise system according to claim 17 wherein the oversized club head has a top edge and a sole, the sole being generally rounded.

19. A golf practice and exercise system according to claim 17 characterized further by the club head having a front and a back and a weight attachable across the back of the club head to selectively weight the club head.

20. A golf practice and exercise system according to claim 19 wherein the weight comprises a plurality of elements selectively combined for selective weighting of the club head.

21. A golf practice and exercise system according to claim 20 wherein the elements are individual plates.

22. A golf practice and exercise system according to claim 17 characterized further by a lower portion of the club head having an extended horizontal recess formed therein for receipt and attachment of selected elements for selectively weighting the club head.

23. A golf practice and exercise system according to claim 22 wherein the elements are individual disks.

24. A golf practice and exercise system according to claim 17 characterized further by the practice golf club having a shaft with a grip having a plurality of alternating annular ridges and recesses to provide a secure grip for the golfer.

25. A golf practice and exercise system according to claim 17 wherein the oversized club head has a peripheral rim defining a large opening through the club head to reduce resistance of the club head when the club is swung.

26. A golf practice and exercise system according to claim 25 characterized further by a lower portion of the club head rim having an extended horizontal recess formed therein for receipt and attachment of selected elements for selectively weighting the club head.

27. A golf practice and exercise system according to claim 26 wherein the elements are individual disks.

28. A golf practice and exercise system according to claim 25 characterized further by the practice golf club having a shaft with a grip having a plurality of alternating annular ridges and recesses to provide a secure grip for the golfer.

* * * * *